United States Patent [19]

Werner, Jr.

[11] 4,280,428

[45] Jul. 28, 1981

[54] NON-HEELING SAILBOAT

[76] Inventor: John Werner, Jr., 11455 Tampa Ave., #167, Northridge, Calif. 91326

[21] Appl. No.: 931,368

[22] Filed: Aug. 7, 1978

[51] Int. Cl.[3] ..... B63B 35/00; B63H 9/00

[52] U.S. Cl. ..... 114/39; 114/61; 114/280; 114/102

[58] Field of Search ..... 114/39, 280, 102, 103, 114/61

[56] References Cited

U.S. PATENT DOCUMENTS

| | | | |
|---|---|---|---|
| 2,756,711 | 7/1956 | Simpson | 114/39 |
| 3,295,487 | 1/1967 | Smith | 114/39 |
| 3,870,004 | 3/1975 | Bailey | 114/39 |
| 3,981,258 | 9/1976 | Smith | 114/39 |
| 4,061,099 | 12/1977 | Cook | 114/39 |

*Primary Examiner*—Trygve M. Blix
*Assistant Examiner*—D. W. Keen

[57] ABSTRACT

A non-heeling sailing vessel having:

a payload bearing first displacement hull with a pair of longitudinally spaced control surfaces rigidly mounted thereto in fixed alignment and extending downwardly therefrom into the water, a rigid support structure rigidly fixed to said hull and extending laterally, at least one upstanding sail rigidly mounted to the support structure, the sail being spaced laterally of and inclined toward the control surfaces for generation of a resultant force directed away from the control surfaces and upwardly in response to the wind, and, a second displacement hull mounted to the support structure intermediate the first displacement hull and the sail.

7 Claims, 7 Drawing Figures

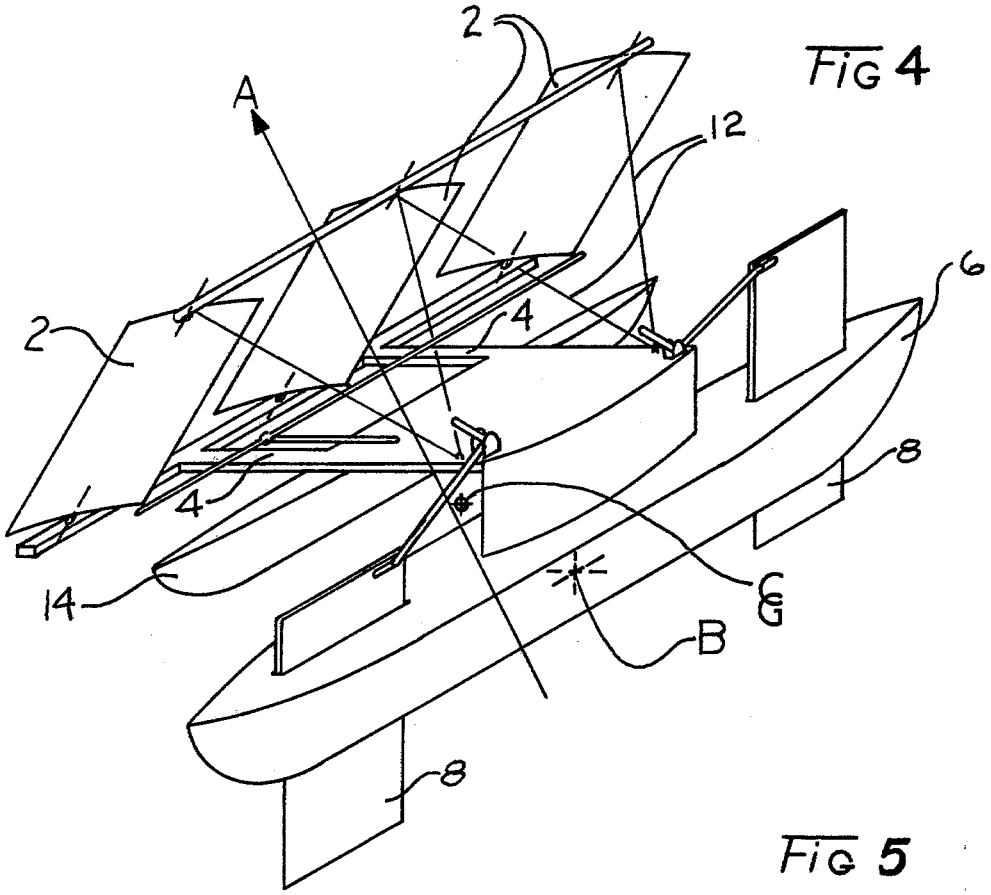
FIG 4
FIG 5
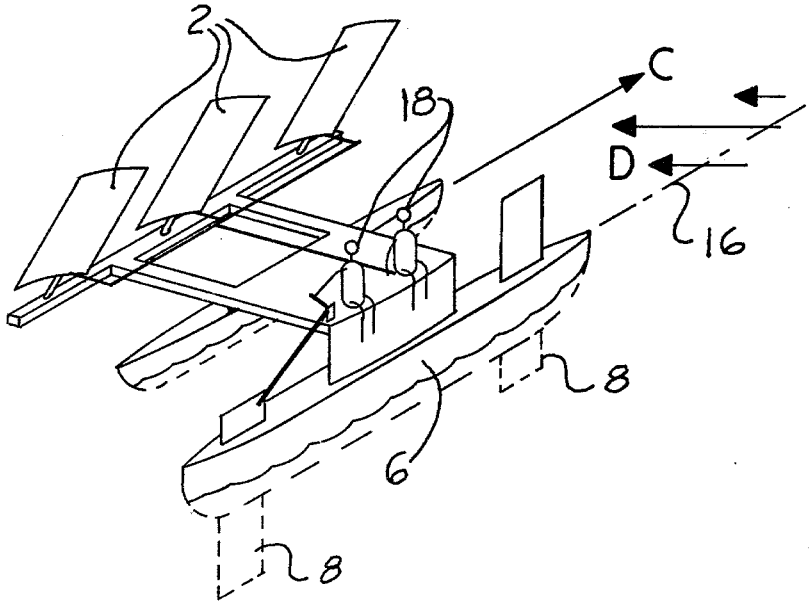

NON-HEELING SAILBOAT

FIELD OF THE INVENTION

This invention relates to sailing boats or vessels, more specifically, the invention is a sailing machine which nearly eliminates water friction. Lifting its own weight by means of lifting sails, the craft becomes nearly airborne with only control surfaces remaining in the water. At such attitude as described above, the craft demonstrates very high speed. As applied to conventional craft (i.e. normal sailboat), the ballast usually required to resist tipping of the boat by wind forces is not necessary, and a greater payload can be carried by the vessel. The prime uniqueness of this invention is the non-tipping ability which allows the breakthrough in high speed sailing.

BACKGROUND

Sailboats of conventional design either mono-hull or multi-hull depend on the flotation or displacement of the hulls to counteract the wind force (torque) which makes them tip or heel. This heeling condition loads the water with added force which causes more displacement and therefore more friction. Even the use of hydrofoils to counteract heeling forces load the water. Without exception (all sailing systems except the ones later noted) the wind force must be balanced or the boat will roll over.

Sailboats of conventional design when heeling or tipping from the wind pressure spill out from their sails wind which is wasted and its energy lost. This lost energy is only saved by balancing the boat with displaced weight. Therefore, a conventional boat can only use as much energy as can be balanced with the weight of the system which limits the wind power a conventional sailboat can handle.

One exception to this rule is a sailing surf board. This system requires the payload or passenger to hang from the sail by means of a boom or bar. This prevents the wind from blowing the sail over and into the water. It is therefore a requirement that the passenger exactly balance the wind forces with his own body weight. This system does not load the water with any excess pressure, but it is limited by the force the passenger can balance with his body weight.

Another exception to this rule is employing a kite of sufficient size to propel craft by the pull of its tether string. This system works well downwind and even to some degree across the wind, but would not work making to windward.

Another example of sailing craft approaching the non-heeling system was invented by Frank Delano and Bernard Smith of Acorn, Virginia, which employs a single payload supporting hull with rods and contrivances to attach a sail some distance downwind from the payload hull. The sail is supported by devices called hydrofoils or hydrofoil shaped floats. These hydrofoil floats also provide steering by means of a lever. This boat is described as speedy. In light to average wind velocities this system hasn't any particular disadvantages. In higher wind velocities the windforce must be accounted for by added loading on the hydrofoils which has to produce added friction with the water. In severe wind velocities this craft probably would bury the sail and hydrofoils in the water and severely strain the system which would prevent further increase in forward velocity. This craft is dubbed by the inventor as a monomaran. A patent for this invention was not indicated in an article in the section "What's New" (page 98, May 1978—Popular Science, Times Mirror Magazine Inc. 380 Madison Ave., New York, N.Y. 10017). This system is the closest state of art searched U.S. Pat. No. 3,981,258 Smith.

A thorough discussion of high speed sailboats is published in a book called the 40 Knot Sailboat U.S. Pat. No. 3,295,487 B. Smith. The best design put forward in this publication is a hydrofoil-borne sailing system which uses water exerted forces to balance wind tipping force. This system is no better than the one called the monomaran.

The physical forces applied to any sailing vehicle or wind driven vehicle are all similar yet the fastest sailboat has a velocity of 33 K, 37.125 mph. This compared to a land sailer or wheeled sailboat with speed capability of 80 mph, or any ice boat which obtains speeds of 100 mph or better, indicates that friction between the craft and its supporting surface radically affects the craft's speed capability.

Conventional sailboats most often carry parasitic weight or ballast well down in the boat to prevent the boat from being completely blown over by the wind. This is at best a compromise and wasteful. It restricts the payload of the craft and the speed at which it might travel.

SUMMARY OF INVENTION

The principal feature of this invention is to provide a sailing system to propel a craft on the water without the disadvantage of tipping or heeling by the wind.

An important aspect of this invention is that it may be used on conventional boats of low velocity and load carrying types. In principle, the sails of the sailing system are attached to the craft in such a way as to achieve lift as well as forward thrust. The lift force is then caused to act upon the craft through its roll center thereby not causing the craft to tip over with the wind pressure.

Another important aspect of this invention is that it becomes unnecessary to use parasitic weight or ballast to produce a force to prevent heeling (i.e. righting force). This weight is then removed from the boat and more payload may be carried.

A further principle of this invention is that a craft so fitted with this sailing system could be sailed in very high wind without fear of being blown over.

The feature principles of this invention when applied to a speed sailing craft (whereas the lifting force is directed below the roll center of the craft) the lifting force will be made to lift the payload of the craft to the extent that it could become completely airborne. At this time the craft would be uncontrollable, therefore some design consideration which keeps the craft in contact with the water must be incorporated. With a craft so designed to be controlled with control surfaces only in the water, high speeds may be achieved. At these speeds conventional control surfaces are not functional and a new system is used. The aspects of this part of the sailing system are that these surfaces must vary in area. An equilibrium must take place between the sail effort and the control surface area. The control surface area must be matched to the sail area.

Another feature of this invention is the method of achieving this area change. Its done by raising and lowering a forward and aft board thru a trunk in the hull by means of a lever attached thereto and pivoting from a hinge point.

To summarize; by placing the sails of a sailboat so as to cause them to lift, the heeling caused by conventional placement of the sails is totally eliminated. This sail placement can cause the sailboat to rotate toward the wind even when the boat has no forward velocity. It will not heel under any circumstances. All of these foregoing principles have been demonstrated with scale models which are in tact and available as proof of this invention.

Other objects, features, and advantages will be apparent from the drawings and detailed description of this invention.

BRIEF DESCRIPTION OF DRAWINGS

FIG. 4 Practical sailing system demonstrated in model form.

FIG. 5 Illustrates method of sailing which demonstrates the invention's advantages.

DETAILED DESCRIPTION OF THE INVENTION

Figure 1:
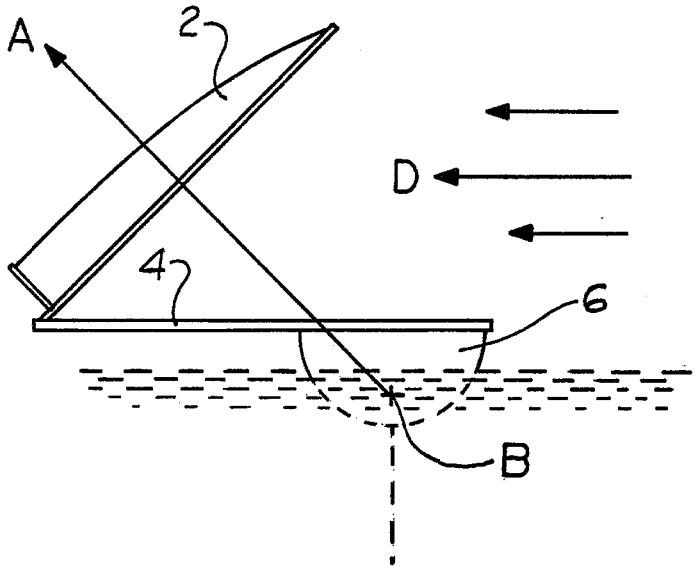
FIG. 1 Illustration of force pattern unique to this invention.

FIG. 1 A sail 2 fixedly attached by beams 4 to the hull 6 in this relationship which causes the sail force A created by the wind D to pass thru and act upon B the roll center of the craft. This force A being neutral about the roll center of the vessel will not cause roll or tipping no matter how great this force becomes.

Figure 2:
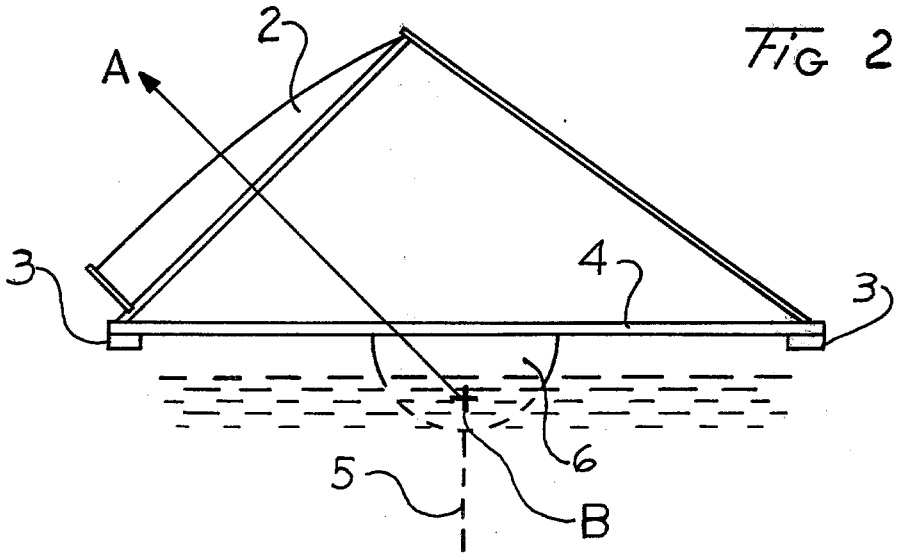
FIG. 2 Practical use of the invention and how it functions on a sailboat.

FIG. 2 Shows as a practical design the system should be balanced about roll center B so some penalty must be paid to place the sail 2 in such a relationship with the hull of the vessel. In the model bouyant outriggers 3 were positioned so as to balance the craft about the roll center B. These outriggers 3 were not required to prevent heeling, but only supplied a means by which to control the sail in the manner of a conventional sailboat. The sail control (sheets, halyards) were fastened to these outriggers. The conventional keel 5 is seen to have no parasitic weight (ballast) thus allowing added payload.

Figure 3:
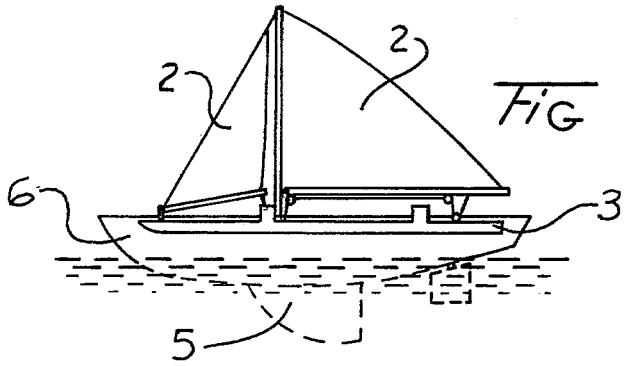
FIG. 3 Similarity of this invention with normal sailboats.

FIG. 3 Shows the conventional location of the sails 2 in relation to the hull 6 and keel 5. In this respect this sailing system is conventional.

FIG. 4 Shows a system designed to sail at high speed. Load bearing hull 6 is used for prime flotation with varying area control surfaces 8 so placed as to produce lateral stability at low and high speeds. Extending from hull 6 are support beams 4 which position sails along with brace 12 so the lifting force A is directed below roll center B. A small support hull 14 is placed beyond the center of gravity of the boat to give equilibrium to the craft at rest.

FIG. 5 Shows how to operate this craft. A wind must be available of sufficient magnitude to provide the forces required to fly the sails. The crew 18 resting upon the load bearing hull 6 then sets the directional trim with 8 variable area control surfaces and the craft will pivot about the larger surface 8 so as to turn.

Figure 6:
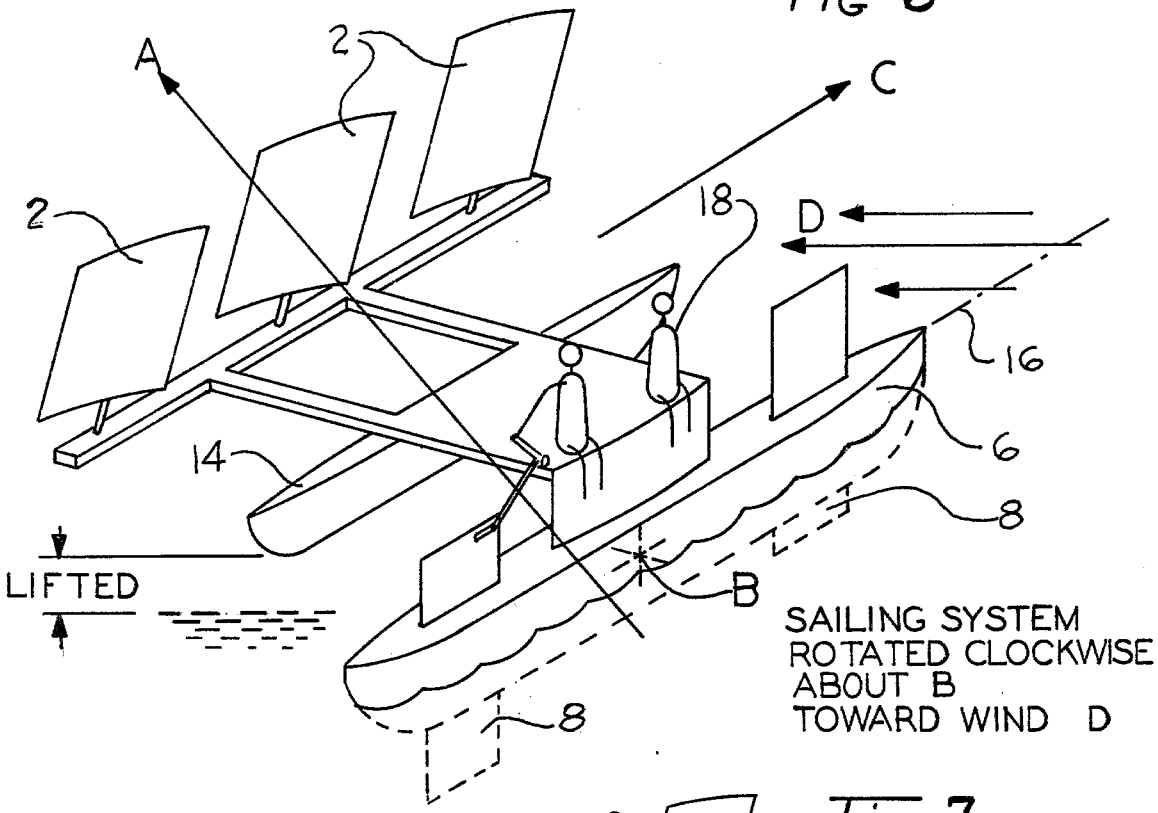
FIG. 6 (same as FIG. 5)

FIG. 6 As the craft turns and the wind D begins to cross the centerline 16 of the hulls, the crew 18 rotates the sails 2 to some angle of attack as in a normal sailboat to produce lifting force. The sails 2 are affixed in this position. The craft begins to move by wind force in direction C with wind blowing as D. The motion C of the craft causes an increase in D due to relative speed of craft and wind D when sufficient lift is produced by the wind D over the sails the craft rotates about its roll center B causing the small hull 14 to lift from the water. This rotation will continue until the sails 2 achieve such a high angle of attack as to loose lift A and the craft beings to lose forward speed C. This will cause the craft to rotate back to the water.

Figure 7:
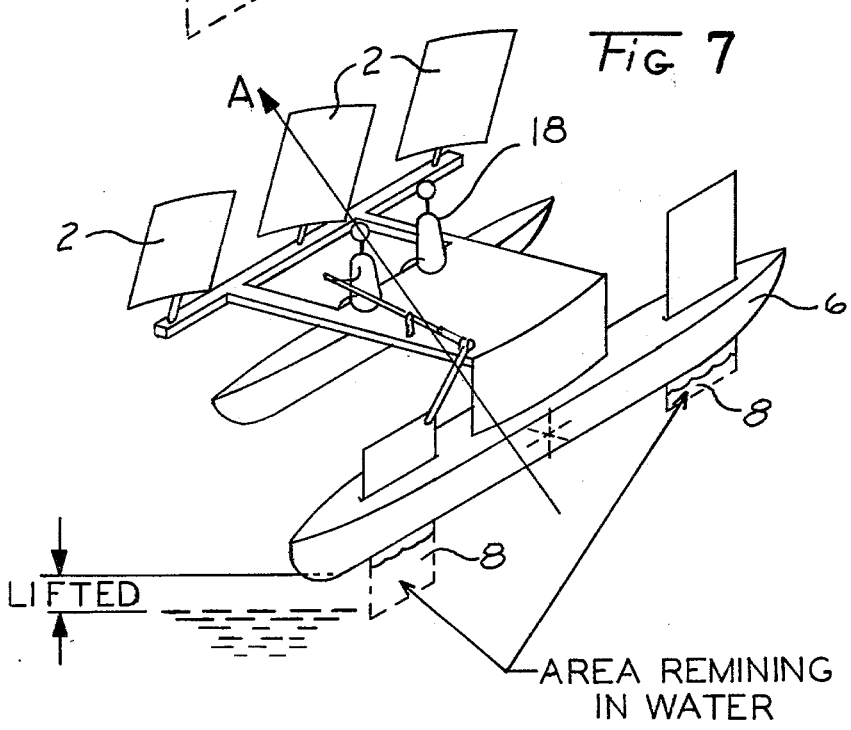
FIG. 7 (same as FIG. 5)

FIG. 7 Shows that the crew 18 (payload) will move toward the sails 2 and place their weight nearer to the lifting force A thus causing their weight (payload) to be borne by force A and removing their weight from hull 6. The result of this is the hull 6 does not have to displace the water required to float the crew (payload) and floats higher in the water which reduces friction and allows more speed. At maximum velocity the vessel would be lifted almost clear of the water. The control surfaces 8 would be retracted to minimum for adequate direction control. This attitude and speed could be maintained as long as the wind held out at sufficient velocity.

What is claimed is:

1. A non-heeling sailing vessel comprising:

a payload bearing first displacement hull having a pair of longitudinally spaced control surfaces rigidly mounted thereto in fixed alignment and extending downwardly therefrom into the water;

a rigid support structure rigidly fixed to said hull and extending laterally thereof; and at least one upstanding sail rigidly mounted to said support structure, said sail being spaced laterally of and inclined toward said control surfaces for generation of a resultant force directed away from said control surfaces and upwardly in response to the wind and, a second displacement hull mounted to said support structure intermediate said first displacement hull and said sail.

2. A non-heeling sailing vessel as defined by claim 1 comprising means for selectively varying the wetted area of each of said control surfaces.

3. A non-heeling sailing vessel as defined by claim 1 comprising means for adjusting the angle of rotation of said sail with respect to said support structure.

4. A non-heeling sailing vessel as defined by claim 1 comprising means for adjusting the angle of inclination of said sail with respect to said support structure.

5. A non-heeling sailing vessel as defined by claim 1 comprising means for selectively varying the wetted area of each of said control surfaces and the angles of rotation and inclination of said sail with respect to said support structure.

6. A non-heeling sailing vessel as defined by claim 1 comprising:

a plurality of longitudinally spaced sails rigidly mounted to said support structure, said sails being spaced laterally of and inclined toward said control surfaces for generation of a resultant force directed away from said control surfaces and upwardly in response to the wind;

means for rotating said sails with respect to said support structure; and means for adjusting the inclination of said sails with respect to said support structure.

7. A non-heeling sailing vessel as defined by claim 1 wherein said sail is a rigid airfoil symmetrical in planiform, and said vessel is symmetrical with respect to a vertical plane containing the perpendicular bisector of the longitudinal axis of said first hull.

* * * * *